United States Patent [19]

Lagerstedt

[11] 4,102,409

[45] Jul. 25, 1978

[54] ROCK DRILLING MACHINE

[75] Inventor: John Arne Lagerstedt, Skärholmen, Sweden

[73] Assignee: Atlas Copco Aktiebolag, Nacka, Sweden

[21] Appl. No.: 748,733

[22] Filed: Dec. 9, 1976

[30] Foreign Application Priority Data

Dec. 11, 1975 [SE] Sweden ..... 7513971

[51] Int. Cl.[2] ..... E21B 1/00

[52] U.S. Cl. ..... 173/50; 173/164; 408/124

[58] Field of Search ..... 173/47, 50, 147, 164; 408/124, 133; 74/25

[56] References Cited

U.S. PATENT DOCUMENTS

| | | | |
|---|---|---|---|
| 1,513,388 | 10/1924 | Greve | 173/164 |
| 2,552,234 | 5/1951 | Thibodeav | 408/124 |
| 2,942,499 | 6/1960 | Macy | 408/124 |
| 3,517,574 | 6/1970 | Glatfelter | 173/163 |
| 3,741,322 | 6/1973 | Wolters | 173/164 |

*Primary Examiner*—Robert A. Hafer
*Attorney, Agent, or Firm*—Flynn & Frishauf

[57] ABSTRACT

A rock drilling machine, e.g. for drilling with a diamond core bit, has a first power rotated chuck for gripping the drill string. The first chuck can be swung offset the drilling axis into a position to grip an input shaft of a reduction gearing coupled to a second chuck. The first chuck and its motor can thus rotate also the second chuck which is used for example for drilling down a borehole lining pipe. The two chucks are mounted on a common slide that is power feedable back and forth along a feed beam or mast.

19 Claims, 6 Drawing Figures

12
15
37
28
31
36
15
13
14
6
20
18
19
6
17
36
11

ROCK DRILLING MACHINE

This invention relates to a rock drilling machine comprising a feed beam along which a slide is power feedable, and a first chuck for rotating and feeding a drill string mounted on the slide, said first chuck being rotatable by means of a motor and having a through opening for the drill string.

When using for example a diamond drilling machine of this kind, it is desirable that it be possible to rotate and feed wider pipes than the drill string, for example lining pipes, with higher torque than required during drilling. This is made possible with a drilling machine according to the invention which also has a second chuck for such wider pipes.

DETAILED DESCRIPTION OF PREFERRED EMBODIMENT

Figure 3:
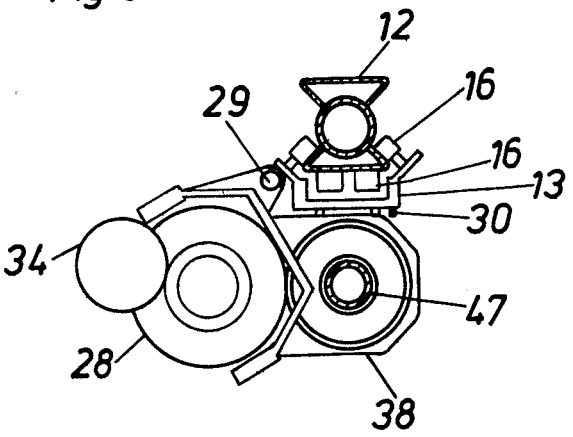
FIG. 3 is a section taken along the line 3—3 in FIG. 2 and it is also a section taken along line 3—3 in FIG. 5 with some of the details in FIG. 5 shown in an alternative position.

The drilling machine shown in the figures is a so called diamond drilling machine that is used mainly for prospecting purposes when it is desired to collect a core. It comprises a frame 11 with a fellable mast in the form of a feed beam 12 along which a slide 13 is arranged to be fed back and forth by means of a feed motor 14 and chains 15. The slide has rollers 16 against the feed beam 12 as can be seen in FIG. 3. The feed beam 12 is axially displaceable so that it can take support against for instance a log 17.

Figure 6:
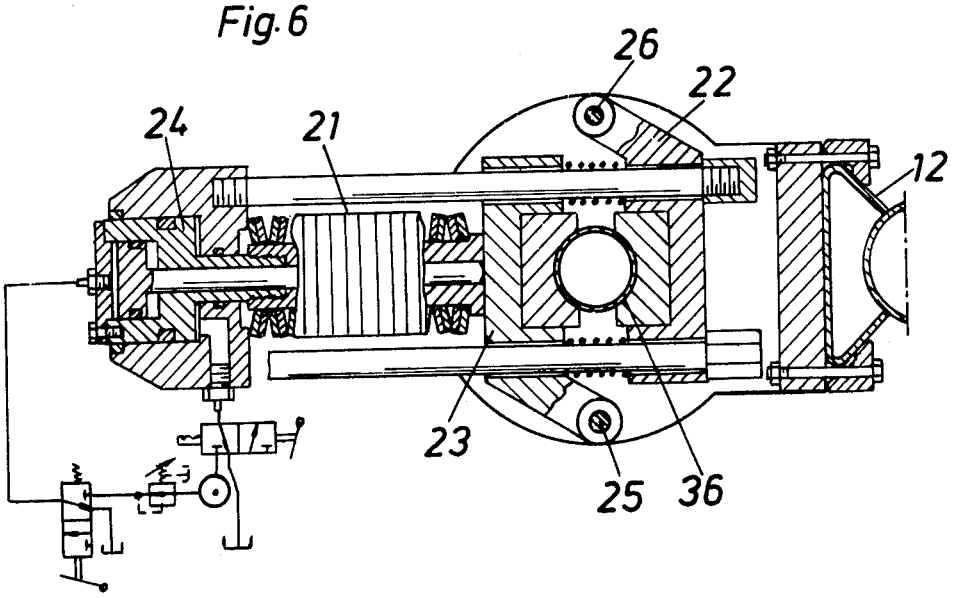
FIG. 6 is a fragmentary section taken along line 6—6 in FIG. 1.

In the lower end of the feed beam there is a clamp 18 by means of which the feed beam can be attached to a lining pipe 19. A pipe holder 20 is mounted on the feed beam above the clamp 18. It has a spring 21 (FIG. 6) coupled between two jaws 22, 23 for forcing the two jaws towards each other to grip a drill pipe 36 and a hydraulically actuated piston 24 for forcibly compressing the spring to permit the jaws to release their grip. The jaws 22, 23 are swingable about pivots 25, 26 that are easy to remove, i.e. the pivots can be affixed by nuts. If the pivot 25 is unscrewed, the entire device consisting of the jaws 22, 23, the spring 21 and the piston 24 may be swung about the pivot 26 away from the drilling axis to permit the lining pipe 19 to be passed through the pipe holder.

Figure 1:
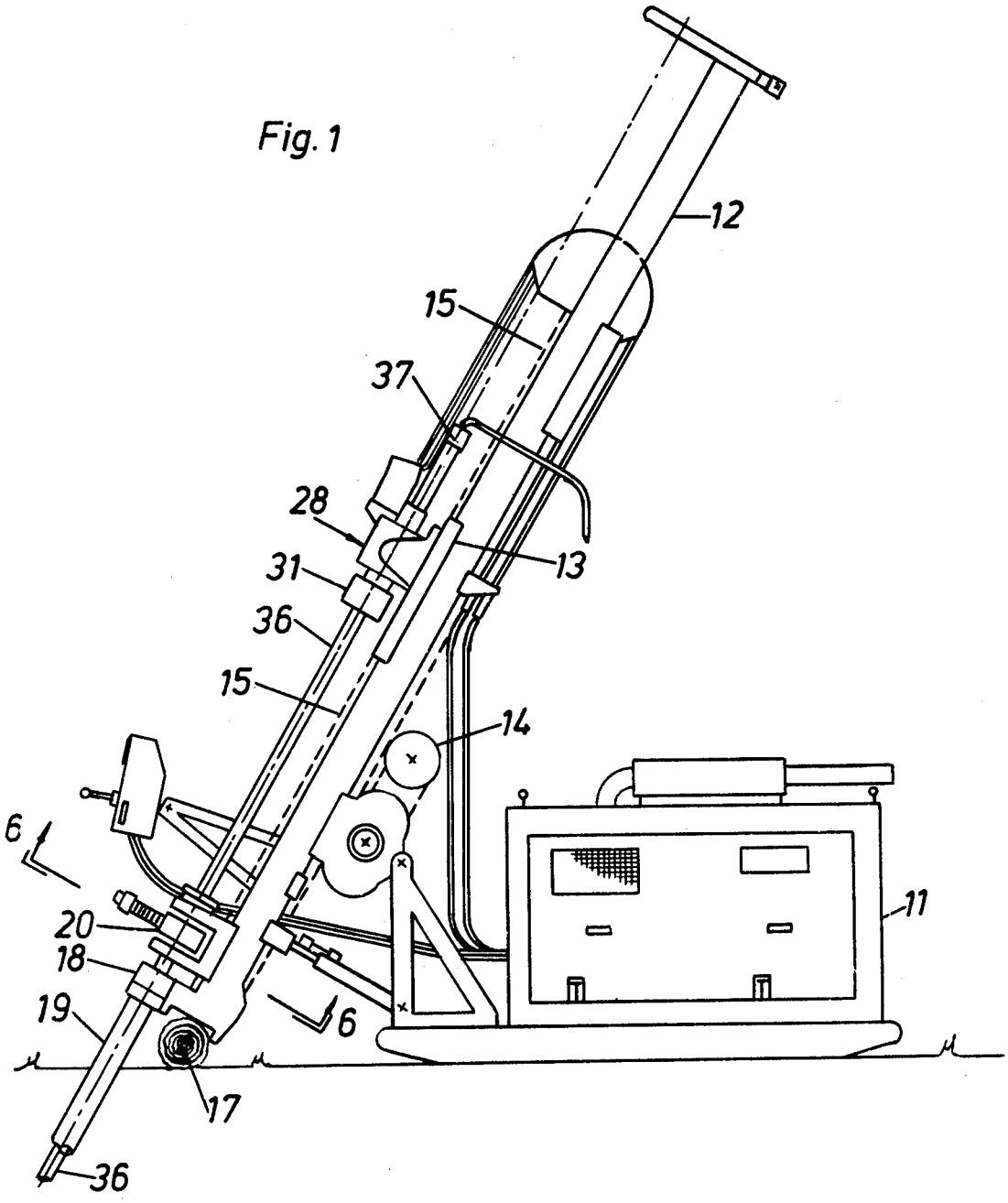
FIG. 1 is a side view of a diamond drilling machine.
Figure 2:
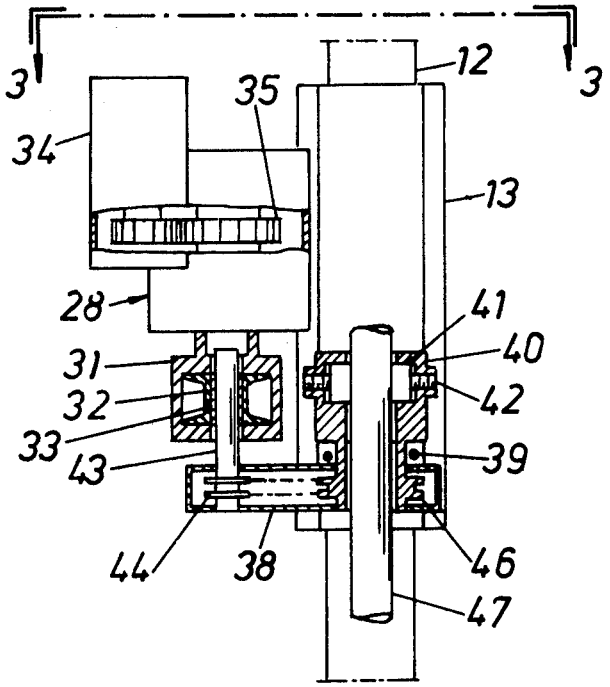
FIG. 2 is a front view of a part of the machine shown in FIG. 1.

On the slide 13, a rotation unit 28 is mounted to be pivotable about an axle 29 (FIG. 3), that is parallel with the feed beam 12, between a position coaxial with the drilling axis as shown in FIG. 1 and an off-set position as shown in FIGS. 2 and 3. The rotation unit 28 is lockable to the slide 13 in its position shown in FIG. 1 by means of screws 30. The rotation unit has a chuck 31 of the kind that has a sleeve-formed rubber piston 32 that forces jaws 33 radially inwardly when its outer surface is subjected to hydraulic pressure. This chuck is not described more closely but reference is made to British Pat. No. 1,237,859 that shows it in detail. A hydraulic rotation motor 34 rotates the chuck 31 via a ring gear 35 that is connected to the chuck and is coaxial therewith. The rotation unit 28 has a through opening for the drill pipe 36 as can be seen in FIG. 1. During drilling, feed force and rotation is thus transmitted (FIG. 1) via the chuck 31 to the drill pipe 36 that, as conventionally, in its lower end has a core barrel with an annular diamond core bit (not illustrated). Flushing fluid is supplied to the pipe through a swivel joint 37.

In FIG. 2, the rotation unit 28 is shown in an outswung position and an additional unit 38 is screwed onto the slide by means of screws 39. This additional unit has a so called screw chuck 40 with jaws 41 that can be screwed radially inwardly by means of screws 42. The additional unit 38 has an input shaft 43 with a sprocket wheel 44 that, via a chain 45, can rotate a sprocket wheel 46 that is unturnable relative to the screw chuck 40. When the additional unit 38 is mounted on the slide 13, its input shaft 43 is put into the chuck 31 of the rotation unit, and since this input shaft has the same diameter as the drill pipe 36 shown in FIG. 1, the chuck 31 of the rotation unit can grip the shaft so that the screw chuck 40 can be rotated by means of the motor 34 of the rotation unit with a reduced rate of revolutions and a high torque as compared with the chuck 31. The screw chuck 40 is intended to grip an outer drill pipe 47.

When it is desired to line a bore hole, the additional unit 38 is mounted and the pipe holder 20 is swung out as described. Then, the outer drill pipe 47 is drilled down by the simultaneous applying of rotation and feed force to it. The outer drill pipe is provided with an annular drill bit. When the outer drill pipe 47 has reached the rock bed, its drilling down is completed and it is attached to the clamp 18. Then the inner drill pipe 36 is drilled down through the outer drill pipe as shown in FIG. 1. The drill pipe 47 can be used as a lining, but sometimes this drill pipe 47 is taken up and replaced by a less expensive lining pipe that does not have a real drill bit.

Figure 5:
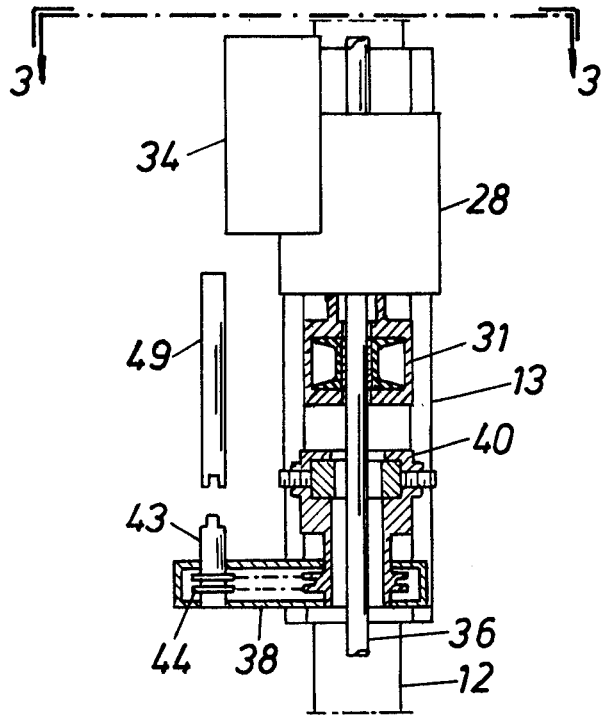
FIG. 5 is a front view corresponding to FIG. 2 but showing the embodiment according to FIG. 4.
Figure 4:
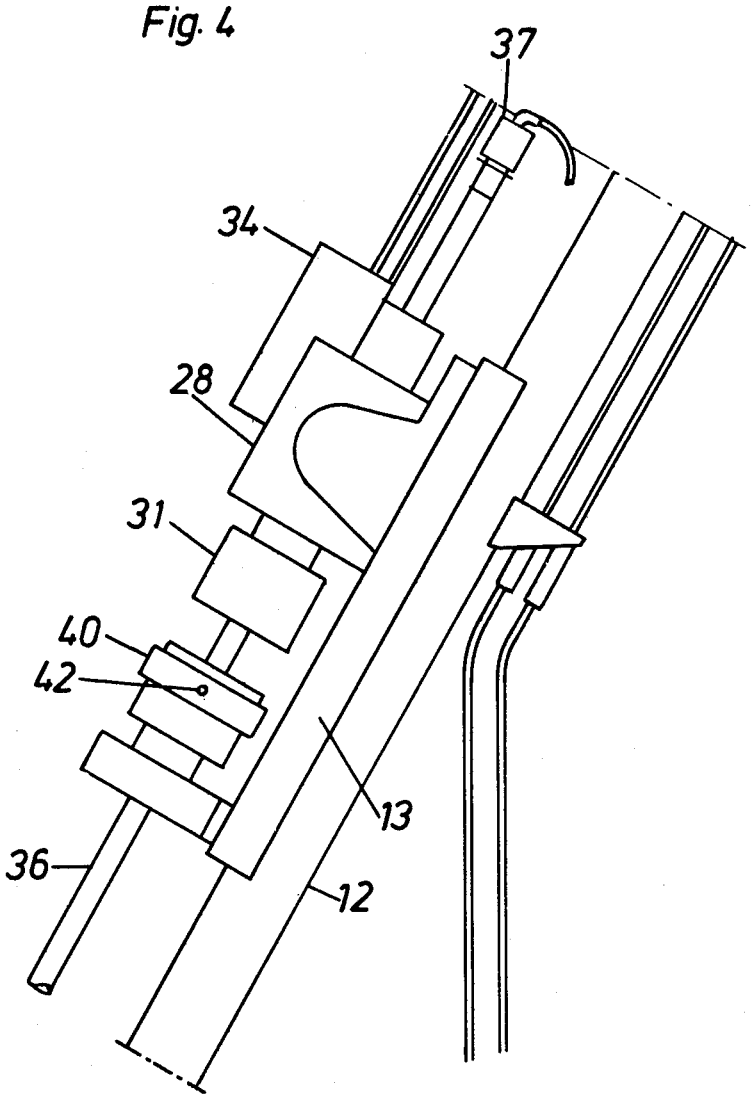
FIG. 4 is a side view of an alternative construction of some details shown in FIGS. 1-3

In the FIGS. 4 and 5, a modified design is shown in which the additional unit according to claim 2 is always mounted on the slide 13. When drilling with the inner drill pipe 36 as shown in these figures, one drills through the screw chuck 40. The rotation unit 28 is swingably mounted in the same way as in the previously described design. In this design, a loose extension part 49 for the input shaft 43 is used to make possible rotation of the input shaft 43 by means of the rotation unit.

What I claim is:

1. Rock drilling machine comprising:

a feed beam (12);

a slide (13) mounted on said feed beam and being movable along said feed beam;

power means (14, 15) coupled to said slide to move said slide along said feed beam;

a first chuck (31) mounted on said slide and having gripping jaws for gripping a drill string (36), said first chuck rotating and feeding the drill string (36) and having a through opening for the drill string;

a motor (34) for rotating said first chuck;

a second chuck (40) mounted on said slide and having gripping jaws for gripping the drill string, said second chuck having a through opening for the drill string;

a reduction gearing (38, 43–46) coupling said second chuck to said motor (34) to be rotated by said motor (34); and means for selectively rotating the drill string by said first and second chucks, said second chuck rotating the drill string with lower revolution rate and high torque than said first chuck.

2. Rock drilling machine according to claim 1, wherein the reduction gearing (38, 43–46) has an input shaft (43) that comprises a drive stub shaft (43) that is off-set to the axis of drilling, said first chuck (31) being transversely displaceable into a position in which it can grip said shaft (43) to rotate it.

3. Rock drilling machine according to claim 2, wherein said second chuck (40) and the reduction gearing (43–46) are built together to form a unit (38) that is detachable from the slide (13).

4. Rock drilling machine according to claim 3, wherein said first chuck (31) and said motor (34) are mounted on the slide (13) so as to be transversely displaceable as a unit (28).

5. Rock drilling machine according to claim 4, wherein said transversely displaceable unit (28) is mounted on the slide (13) to be transversely swingable and is lockable with its chuck (31) coaxial with the drill axis.

6. Rock drilling machine according to claim 1, wherein said jaws of said second chuck are adapted to grip an outer drill pipe (47) and said jaws of said first chuck are adapted to grip an inner drill pipe (36) that can be drilled through the outer drill pipe.

7. Rock drilling machine according to claim 1, wherein said second chuck (40) is mounted forwardly of said first chuck (31).

8. Rock drilling machine according to claim 1 comprising a drill string holder (20) with jaws for gripping the drill string mounted on the front portion of the feed beam (12), at least a portion of the drill string holder (20) being swingable away.

9. Rock drilling machine according to claim 1 wherein said gripping jaws of said second chuck are dimensioned so as to grip a drill string of a greater diameter than the jaws of said first chuck.

10. Rock drilling machine according to claim 2, wherein said first chuck (31) and said motor (34) are mounted on the slide (13) so as to be transversely displaceable as a unit (28).

11. Rock drilling machine comprising:

a feed beam (12);

a slide (13) mounted on said feed beam and being movable along said feed beam;

power means (14, 15) coupled to said slide to move said slide along said feed beam;

a first chuck (31) mounted on said slide for rotating and feeding a drill string (36) and having a through opening for the drill string;

a motor (34) for rotating said first chuck;

a second chuck (40) mounted on said slide for gripping the drill string; and a reduction gearing (38, 43–46) selectively coupling said second chuck to said motor (34) via said first chuck (31) so as to rotate said second chuck by said motor (34), said reduction gearing including an input shaft (43) that comprises a drive stub shaft (43) that is off-set to the axis of drilling, said first chuck (31) being transversely displaceable into a position in which it can grip said shaft (43) to rotate it to thereby rotate said second chuck;

said second chuck rotating the drill string with lower revolution rate and higher torque than said first chuck.

12. Rock drilling machine according to claim 11, wherein said second chuck (40) and the reduction gearing (43–46) are built together to form a unit (38) that is detachable from the slide (13).

13. Rock drilling machine according to claim 11, wherein said second chuck (40) has jaws (41) for gripping an outer drill pipe (47) and said first chuck (31) has jaws for gripping an inner drill pipe (36) that can be drilled through said outer drill pipe.

14. Rock drilling machine according to claim 11 comprising a drill string holder (20) with jaws for gripping the drill string mounted on the front portion of the feed beam (12), at least a portion of the drill string holder (20) being swingable away.

15. Rock drilling machine for use with an outer drill pipe (47) and an inner drill pipe (36) that can be drilled through the outer drill pipe, comprising:

a feed beam (12);

a slide (13) mounted on said feed beam and being movable along said feed beam;

power means (14, 15) coupled to said slide to move said slide along said feed beam;

a first chuck (13) mounted on said slide and having gripping jaws for gripping the inner drill pipe (36), said first chuck rotating and feeding the inner drill pipe (36) and having a through opening for the inner drill pipe;

a motor (34) for rotating said first chuck;

a second chuck (40) mounted on said slide and having gripping jaws for gripping the outer drill pipe (47);

a reduction gearing (38, 43–46) coupling said second chuck to said motor (34) to be rotated by said motor (34); and means for selectively rotating the drill pipes by said first and second chucks, said second chuck rotating the outer drill pipe with lower revolution rate and high torque than said first chuck.

16. Rock drilling machine according to claim 15, wherein said second chuck (40) and the reduction gearing (43–46) are built together to form a unit (38) that is detachable from the slide (13).

17. Rock drilling machine comprising a feed beam (12);

a cradle (13) mounted on said feed beam and being movable along said feed beam;

power means (14, 15) coupled to said cradle to move said cradle along said feed beam;

a first drill (28) mounted on said cradle and having a through opening to permit a drill string to extend through said first drill, said first drill comprising power operated gripping means (32, 33) capable of firmly gripping the drill string, and a motor (34) for rotating said gripping means; and a second drill (38) mounted on said cradle, said second drill (38) comprising a rotatable member (40), a shaft (43, 49) offset to said rotatable member, and a gear-down transmission (44, 46) coupled between said shaft and said rotatable member, said rotatable member comprising coupling means (41) for coupling the rotatable member to a drill string that is wider than said through opening of said first drill;

said first drill being laterally displaceable on said cradle into a position in which its gripping means is in position to grip said shaft of the second drill.

18. Rock drilling machine according to claim 17 wherein said first drill is swingable on said cradle to its drilling position, and wherein said second drill (38) is removably attached to said cradle and so located on said cradle that it must be removed from said cradle before said first drill can be swung to its drilling position.

19. Rock drilling machine according to claim 17, wherein said coupling means of said second drill (38) comprises gripping jaws (41) and said second drill has a through opening to permit a drill string gripped by said gripping jaws (41) to extend through said second drill.

* * * * *